United States Patent [19]

Miyamoto et al.

[11] 4,291,528

[45] Sep. 29, 1981

[54] MOUNTING OF FIBER SUPPLY CHANNEL DEFINING MEANS IN SPINNING UNITS OF AN OPEN END SPINNING MACHINE

[75] Inventors: Noriaki Miyamoto; Masao Shiraki, both of Kariya; Kinpei Mitsuya, Aichi, all of Japan

[73] Assignee: Kabushiki Kaisha Toyoda Jidoshokki Seisakusho, Kariya, Japan

[21] Appl. No.: 96,170

[22] Filed: Nov. 20, 1979

[30] Foreign Application Priority Data

Nov. 24, 1978 [JP] Japan ..... 53-162231[U]

[51] Int. Cl.[3] ..... D01H 7/892

[52] U.S. Cl. ..... 57/58.95; 57/58.89

[58] Field of Search ..... 57/58.89–58.95

[56] References Cited

U.S. PATENT DOCUMENTS

| | | | |
|---|---|---|---|
| 3,785,138 | 1/1974 | Rajnoha et al. | 57/58.95 |
| 3,797,218 | 3/1974 | Landwehrkamp et al. | 57/58.95 X |
| 3,884,028 | 5/1975 | Stahlecker et al. | 57/58.95 X |
| 3,901,013 | 8/1975 | Sharychenkov | 57/58.95 |
| 3,938,310 | 2/1976 | Didek et al. | 57/58.95 X |
| 4,008,562 | 2/1977 | Vecera et al. | 57/58.95 |
| 4,014,162 | 3/1977 | Stahlecker | 57/58.95 |
| 4,024,699 | 5/1977 | Goldammer et al. | 57/58.95 X |
| 4,098,065 | 7/1978 | Stahlecker et al. | 57/58.95 |

FOREIGN PATENT DOCUMENTS 49-14973 4/1974 Japan .

*Primary Examiner*—John Petrakes

*Attorney, Agent, or Firm*—Wenderoth, Lind & Ponack

[57] ABSTRACT

An open end spinning machine includes a plurality of spinning units, in each of which a sliver is opened by a carding roller and transported, in the form of individually opened fibers, into a spinning rotor through a fiber supply channel provided in a housing for the carding roller. The supply channel has a mouth opening towards the carding roller with a fiber separating edge, which is greatly subject to wear during operation of the spinning unit. A portion of the carding roller housing, which defines at least the fiber separating edge, is detachable from another portion of the housing and is urged in a predetermined direction by a biassing spring so that any undesirable clearance, which would be produced between the portions of the housing by structurally separating them from each other, can substantially removed.

7 Claims, 4 Drawing Figures

MOUNTING OF FIBER SUPPLY CHANNEL DEFINING MEANS IN SPINNING UNITS OF AN OPEN END SPINNING MACHINE

BACKGROUND OF THE INVENTION

This invention relates to spinning units of an open end spinning machine, and more particularly to mounting of fiber supply channel defining means in such spinning units.

Each spinning unit of an open end spinning machine generally includes a spinning rotor mounted for rotation with an inner frustoconical surface defining a maximum inner diameter portion at which individual fibers are formed into a yarn, and stationary means having a body defining a housing within which a carding roller is mounted for rotation to open a sliver into the aforementioned individual fibers. The body of the stationary means includes a portion, which slightly enters the spinning rotor through the opened end thereof and defines a fiber supply channel or passage to allow the individual fibers to be supplied from the carding roller into the spinning rotor therethrough. Thus, the supply channel has opposite mouths respectively opening towards the carding roller and the spinning rotor. The mouth opening towards the carding roller is defined at least in part by an edge portion, of which the sharp edged part is generally referred to as a fiber separating edge.

In such spinning units, since the fibers which have been individually opened by the carding roller are separated from the carding roller by the fiber separating edge, i.e., the fibers pass across the fiber separating edge and through the supply channel, the fiber separating edge will always be subject to wear during operation of the spinning machine. Therefore, after a certain period of operation, the fiber separating edge will wear away, resulting in a poor fiber separating function.

Furthermore, the fiber supply channel generally converges towards the mouth of the spinning rotor side so as to limit radially outward movement of the individual fibers in the supply channel, thereby to allow the fibers to be supplied onto the inner frustoconical surface of the spinning rotor in a most favorable condition. However, such a configuration of the supply channel will cause undesirable matter, such as oil, lubricant and cotton wax, contained in the fibers to adhere to the supply channel surface due to an increasing contact of the fibers with the supply channel surface. After a certain period of spinning operation, the quantity of such matter will become considerable, which may interfere with the movement of the separate fibers through the fiber supply channel.

In order to avoid the above disadvantages, it is therefore necessary to renew the portion with the fiber separating edge and periodically to clean off the adhering matter.

SUMMARY OF THE INVENTION

It is therefore a principal object of this invention to provide a spinning unit including a carding roller accommodated within a housing, of which a portion including at least a fiber separating edge is detachably arranged in the housing so as to not cause the above-mentioned disadvantages.

In general, an open end spinning machine incorporating the present invention includes a plurality of spinning units, in each of which a sliver is opened by a carding roller and transported, in the form of individually opened fibers, into a spinning rotor through a fiber supply channel provided in a housing for the carding roller and arranged between the carding roller and the spinning rotor. The supply channel has a mouth opening towards the carding roller with a fiber separating edge. According to this invention, a portion of the carding roller housing, which defines at least the fiber separating edge, is detachable from another portion of the housing and is urged in a predetermined direction by a biassing spring so that any undesirable clearance, which would be created between such portions of the housing by structurally separating them from each other, can be substantially removed.

BRIEF DESCRIPTION OF THE DRAWINGS

This invention will become more readily apparent from the following detailed description taken in conjunction with the accompanying drawings, in which similar or corresponding components are designated by the same reference numerals throughout the several figures and in which.

DESCRIPTION OF THE PREFERRED EMBODIMENTS

Figure 1:
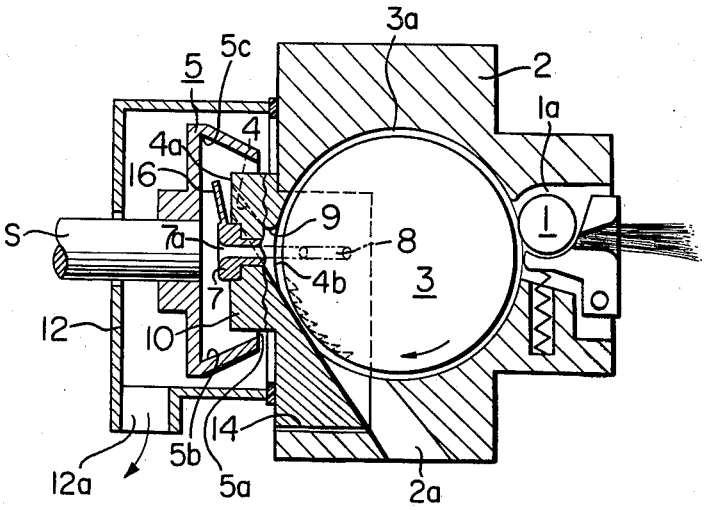
FIG. 1 is a plan view, in section, of a spinning unit constructed in accordance with the present invention.
Figure 2:
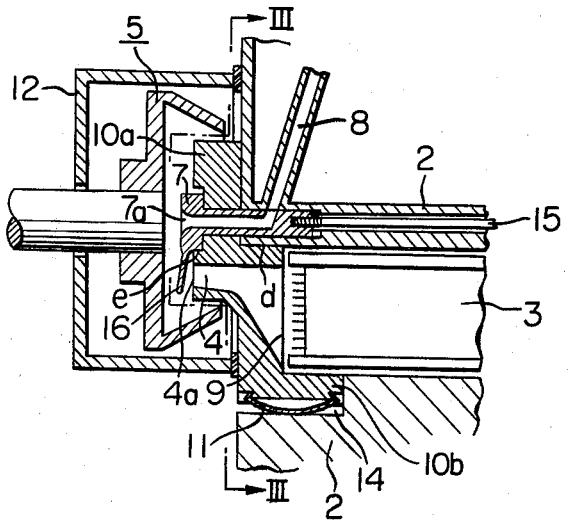
FIG. 2 is a side elevational view, in section, of the spinning unit shown in FIG. 1.
Figure 3:
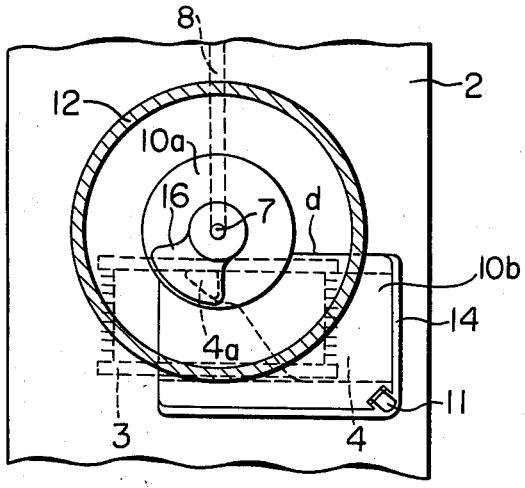
FIG. 3 is a sectional view taken on line III—III of FIG. 2, looking in the direction indicated by the arrows.

Referring to FIGS. 1 to 3, there is shown one spinning unit of an open end spinning machine incorporating this invention. Each spinning unit includes a spinning rotor 5 mounted for rotation on a rotary shaft S in a conventional manner, and a carding roller 3 mounted for rotation within a casing or housing 2 in a not shown conventional manner.

The spinning rotor 5 has an opened end or an opening 5*a* on the side remote from the shaft S, and a frustoconical inner surface 5*b* converging towards the opening 5*a* and forming a maximum inner diameter portion 5*c* in cooperation with the bottom of the spinning rotor 5. The housing 2 defines chambers 3*a* and 1*a* for receiving respectively the carding roller 3 and a sliver feed roller 1 and has a portion 10 slightly extending into the spinning rotor 5 to close the opening 5*a* thereof. Such portion 10 has a fiber supply channel 4 formed therein, which has mouths 4*a* and 4*b* opening respectively towards the inside of the spinning rotor 5 and the chamber 3*a* for receiving the carding roller 3. The portion 10 also has an opening formed therein, which opening receives a somewhat cylindrical member 7 provided with a yarn outlet channel 7*a*.

In operation of such a spinning unit, a sliver fed by the feed roller 1 onto the known sliver carding surface of the carding roller 3 is opened by the carding roller into individual fibers, which are separated from the carding roller 3 at a region of separating edge 9 of mouth 4*b* and then transported through the fiber supply channel 4 into the spinning rotor 5 by an incoming flow of air produced in a passage 2*a* due to rotation of the spinning rotor 5. The passage 2*a* is provided in the housing 2 so as to extend substantially tangential to the cylindrical surface of the carding roller 3 and in line with the fiber supply channel 4. Then, the individual fibers slide down (leftwardly as viewed in FIG. 1) along the inner frustoconical surface 5*b* and reach the maximum inner diameter portion 5*c* of the spinning rotor 5, at which the fibers are formed into a yarn in a known manner and then discharged through the yarn outlet channel 7*a* and hence a yarn withdrawal pipe 8 connected to the member 7 defining the yarn outlet channel 7*a*.

The spinning rotor 5 is surrounded by an air discharge housing 12 including an outlet port 12*a*, which may be connected to air suction means (not shown) so that air within the spinning rotor 5 can be discharged through the opening 5*a* and then the outlet port 12*a*, thereby developing the incoming flow of air in the passage 2*a* and the fiber supply channel 4.

It is therefore understood from the foregoing that the fibers just separated from the carding roller 3 always pass across the fiber separating edge 9 of the mouth 4*b* positioned on the downstream side with respect to the rotation of the carding roller 3, and that the fiber separating edge 9 is always subject to wear during the spinning operation. Thus, the fiber separating function of the edge 9 will be deteriorated after a certain period of operation to the extent that replacement of the portion 10 having the fiber separating edge 9 becomes necessary. In addition, since the fiber supply channel 4 is converged toward the mouth 4*b* thereof to suppress the radially outward movement of the individual fibers in the supply channel 4, undesirable matter, such as oil, lubricant and cottom wax, contained in the fibers will be apt to adhere to the walls of the supply channel 4 and the adhering matter will trap micro impurities contained in the fibers. In that case, the supply channel 4 may change in its cross sectional area to the extent that the fibers will meet with strong resistance as they are transported through the supply channel 4. Therefore, the adhering matter and the trapped micro impurities must be periodically removed.

According to one embodiment of this invention, the portion 10 including at least the fiber separating edge 9 is detachable from another portion of the carding roller housing 2. This portion 10 also includes, in addition to the fiber separating edge 9, the whole fiber supply channel 4, the part 10*a* extending into the spinning rotor 5, and the part 10*b* forming the upper left-hand part of the air passage 2*a*, as viewed in FIG. 1. The part 10*a* extending into the spinning rotor is of a substantially cylindrical shape, and the part 10*b* forming the part of the air passage 2*a* is of a substantially rectangular shape shown in FIGS. 1 to 3 and complementary to a depression 14 formed in another portion of the housing 2 so as to produce a snug fit in the depression 14. The member 7 defining the yarn outlet channel 7*a* centrally extends through the part 10*a*, and the mouth 4*a* of the supply channel 4 is arranged closely adjacent to a boundary surface e between the outer cylindrical surface of a larger diameter portion of the member 7 and a cylindrical surface of a recess formed in the part 10*a* to receive the larger diameter portion of the member 7. At a position closely adjacent to the supply channel 4, there is a boundary surface d between the part 10*b* of the portion 10 and another portion of the housing 2. To fix a position of the member 7, a screw threaded bar 15 is adjustably connected to the free end of the smaller diameter portion of the member 7.

However, if there is any clearance in the region of the boundary e, the fibers once discharged out of the supply channel 4 will encounter the possibility of being trapped in the clearance. The fibers discharged through the mouth 4*a* of the supply channel 4, along with the flow of air, instantaneously diverge in the spinning rotor 5. Especially where a separator 16 is disposed in front of the mouth 4*a*, since the fibers impinge on the surface of the separator 16, their divergence is greater facilitated. As a result, part of the diverged fibers is apt to be trapped in the clearance at the boundary e. Also, as best shown in FIG. 2, the boundary d between the somewhat rectangular part 10*b* of the portion 10 and the part of another portion of the housing 2 extending over the top of the carding roller 3 is positioned closely adjacent to the fiber supply channel 4. If there is any clearance in the region of this boundary d, the fibers just separated from the carding roller 3 will be trapped in the clearance at the boundary d.

It is therefore understood that occurrence of such clearances must be avoided. For this purpose, the portion 10 of the housing 2 is adapted to be urged by elastic means 11 in a predetermined direction, in which any possible clearances in the regions of the boundaries d and e become substantially null. The elastic means 11 also serves to maintain the portion 10 in a fixed position with respect to another portion notwithstanding vibration of the components during the spinning operation. In the specific embodiment shown in FIGS. 1 to 3, the biassing means 11 is in the form of a leaf spring disposed, within the depression 14, at a position between the bottom of the part 10*b* of the housing portion 10 and the associated bottom of the depression 14, preferably at the right-hand corner as viewed in FIG. 3.

With such an arrangement as accords with this invention, there occur no clearances in the regions of the boundaries d and e respectively closely adjacent to the fiber supply channel 4 and the mouth 4*b* of the supply channel due to the presence of the biassing spring 11. It is therefore understood that, during the spinning operation, not only are the fibers being transported through the supply channel 4 not trapped at the boundary d, but also the fibers discharged out of the supply channel 4 are not caught at the boundary e. In addition, due to the elasticity of the biassing means 11, the housing portion 10 can be maintained in a fixed position notwithstanding vibration of the spinning unit components during the spinning operation.

When it is desired to clean off undersirable matter, such as oil, lubricant and cotton wax, contained in the fibers or to replace the portion 10 having a worn out fiber separating edge 9, with a new one, the unclean or worn out portion 10 can be easily disengaged from another portion of the housing merely by depressing that portion 10 against the eleasticity of the biassing spring 11. Thus, the cleaning and replacement of the housing portion 10 can be effected with ease.

Figure 4:
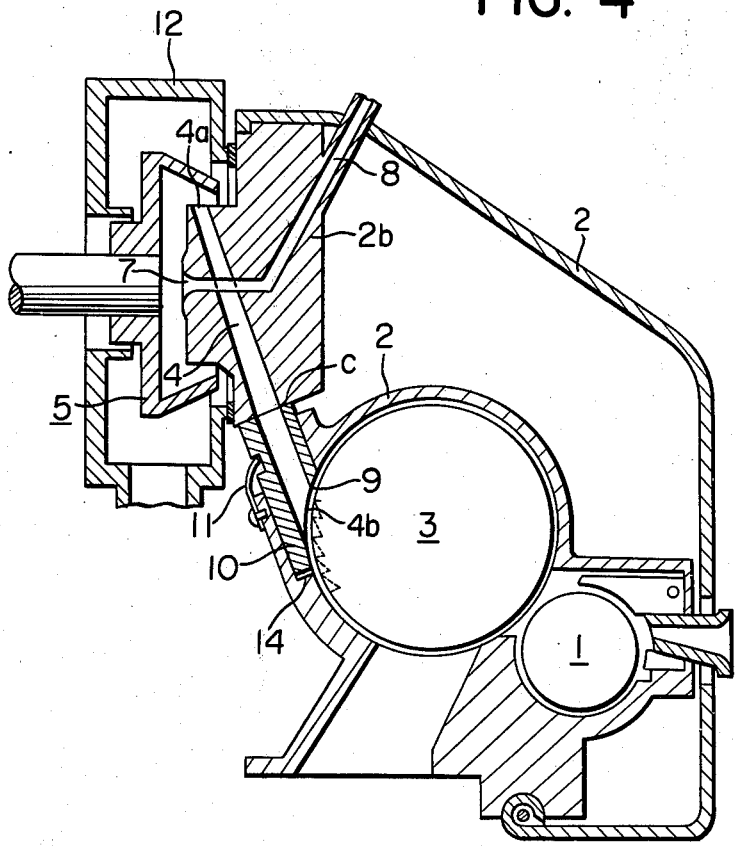
FIG. 4 is a sectional view corresponding to FIG. 1, showing a different modification of the invention.

Another embodiment of this invention is shown in FIG. 4, wherein the portion 10 detachable from the housing 2 comprises a part defining the half of the supply channel 4 on the upstream side with respect to the transportation of the fibers through the supply channel, in addition to a part forming the fiber separating edge 9. In this specific embodiment, the portion 10 is of a rather simple rectangular shape and is disposed in a mating depression 14 provided in another portion of the housing 2 while being urged by a biassing means in the form of a leaf spring 11 toward the part 2*b* of the other portion of the housing 2, which part 2*b* defines both the yarn outlet channel 7 and the downstream half of the supply channel 4 and slightly extends into the spinning rotor 5 to close the opening 5*a* thereof. Therefore, it is possible to substantially avoid occurrence of any clearance in the region of a boundary c between the adjacent end surfaces of the portion 10 and part 2*b* of the other housing portion.

Consequently, as in the first embodiment shown in FIGS. 1 to 3, during the spinning operation, not only can the portion 10 be maintained in a fixed position with respect to the part 2*b* notwithstanding vibration of the components, but also air, which will provide a fiber transporting flow of air in the fiber supply channel 4, is allowed to enter the fiber supply channel 4 only through the mouth 4*b* thereof. That is, no air is allowed to flow into the supply channel 4 through the boundary c. Thus, it can be appreciated that the portion 10 does not cause any deterioration of the fiber transporting ability and no phenomenon such as the trapping of fibers in the junction c is produced.

Furthermore, when it is desired to carry out cleaning or replacement of the unclean or worn out portion 10, this portion 10 can be easily removed in substantially the same manner as that explained with reference to the first embodiment. Also, after removal of the portion 10, the downstream half of the fiber supply channel 4 can be easily cleaned as it is diminished in length.

The portion 10 shown in FIGS. 1 to 4 may be advantageously made of a highly abrasion-resistant material, such as steel, plastic of the polyamide type, sintered alumina, sintered glass, ceramic or another suitable material.

The invention may provide for various detachable portions defining different fiber supply channels or channel parts, from which the one most adapted for specific spinning conditions can be selected at will.

While the invention has been illustrated and described with reference to preferred embodiments thereof, it is to be understood that various changes in the details of the constructions may be made without departing from the spirit and scope of the invention.

What we claim is:

1. A spinning unit in an open end spinning machine, said unit comprising:

a carding roller housing;

a carding roller positioned within said housing for opening a sliver into individual fibers;

a spinning rotor for receiving said individual fibers and for spinning them into yarn;

said housing having therein a fiber supply channel having first and second mouths opening toward said carding roller and said spinning rotor, respectively, for enabling said individual fibers to be transported from said carding roller to said spinning rotor;

said housing including a first portion having at least a part defining a fiber separating edge at said first mouth;

said housing including a second portion substantially enclosing said carding roller;

said first and second housing portions being separable from each other;

coupling means for separably connecting said first housing portion to said second housing portion, said coupling means comprising a surface portion of said second housing portion engageable with said first housing portion, and biasing means disposed between and acting on said first and second housing portions for biasing said first housing portion against said surface portion of said second housing portion, thereby detachably and resiliently mounting said first housing portion on said second housing portion.

2. A spinning unit as claimed in claim 1, wherein said first housing portion is biased against said second housing portion substantially in a direction in which said individual fibers are transported through said fiber supply channel.

3. A spinning unit as claimed in claim 1 or claim 2, wherein said first housing portion further includes a substantially annular part integral with said part defining said fiber separating edge and slightly extending into said spinning rotor, and further comprising a member defining a yarn withdrawal channel and extending through said annular part of said first housing portion, said biasing means comprising a leaf spring disposed in pressure contact with said fiber separating edge defining part of said first housing portion at a position remote from said annular part of said first housing portion.

4. A spinning unit as claimed in claim 3, wherein said fiber separating edge defining part comprises a substantially rectangular block, and said leaf spring is disposed at one corner of said block most remote from said annular part of said first housing portion.

5. A spinning unit as claimed in claim 1 or claim 2, wherein said fiber supply channel converges toward said second mouth opening toward said spinning rotor.

6. A spinning unit as claimed in claim 1 or claim 2, wherein said first housing portion defines a part of said fiber supply channel, said second housing portion defines the remainder of said fiber supply channel, and said biasing means urging said part of said fiber supply channel against said remainder of said fiber supply channel, to thereby avoid the occurrence of any clearance at the junction between said part and said remainder of said fiber supply channel.

7. A spinning unit as claimed in claim 1 or claim 2, wherein said first housing portion is formed of a highly abrasion-resistant material.

* * * * *